US005886461A

United States Patent [19]

Chadha

[11] Patent Number: 5,886,461

[45] **Date of Patent: *Mar. 23, 1999**

[54] TRANSPARENT CONDUCTOR FOR FIELD EMISSION DISPLAYS

[75] Inventor: Surjit S. Chadha, Meridian, Id.

[73] Assignee: Micron Display Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 547,504

[22] Filed: Oct. 24, 1995

[51] Int. Cl.[6] ..... H01F 1/02

[52] U.S. Cl. ..... 313/355; 313/310; 313/326; 313/336; 313/346 R; 313/351; 428/697; 428/699; 428/701; 428/702

[58] Field of Search ..... 313/109, 355, 313/310, 326, 336, 346 R, 351; 428/697, 699, 701, 702

[56] References Cited

U.S. PATENT DOCUMENTS

| | | | |
|---|---|---|---|
| 2,429,420 | 10/1947 | McMaster . | |
| 2,564,707 | 8/1951 | Mochel . | |
| 3,239,368 | 3/1966 | Goodman . | |
| 3,589,789 | 6/1971 | Hubert et al. | 313/109 |
| 3,848,245 | 11/1974 | Marshall | 313/108 |
| 4,486,499 | 12/1984 | Morimoto | 428/701 |
| 4,571,521 | 2/1986 | Gallaro et al. | 313/402 |
| 5,066,883 | 11/1991 | Yoshioka et al. | 313/351 |
| 5,342,477 | 8/1994 | Cathey . | |
| 5,594,297 | 1/1997 | Shen et al. | 313/309 |

FOREIGN PATENT DOCUMENTS

| | | |
|---|---|---|
| 1 045 612 | 8/1957 | Germany . |

OTHER PUBLICATIONS

The Properties of Some Reactively Sputtered Metal Oxide Films, L. Holland & G. Siddall, Oct., 1953.

Preparation and Properties of Stannic Oxide Films by Reactive Cathode Sputtering, V. M. Vaynshteyn, Jun. 26, 1965.

*Primary Examiner*—Archene Turner

*Attorney, Agent, or Firm*—Hale and Dorr LLP

[57] ABSTRACT

The present invention is directed to a conductor/electrode for a faceplate anode of a field emission display wherein said conductor/electrode is comprised of tin oxide. Alternatively, the present invention is directed to a transparent conductor/electrode for a faceplate anode of a field emission display wherein said conductor/electrode is comprised of from about 90% to about 99% tin oxide and from about 1% to about 10% antimony.

13 Claims, 1 Drawing Sheet

TRANSPARENT CONDUCTOR FOR FIELD EMISSION DISPLAYS

This invention was made with Government support under contract number DABT63-93-C-0025 awarded by Advanced Research Projects Agency (ARPA). The Government has certain rights in this invention.

FIELD OF THE INVENTION

The invention relates to transparent conductors for faceplates of field emission display devices wherein said conductors are directly bombarded with electrons.

BACKGROUND OF THE INVENTION

Displays, such as those commonly used in lap-top computer screens function as a result of energy or voltage responsive substances (whether liquid crystals, plasma, phosphors, electrochemic, electrophoretic and other materials) disposed between electrodes at least one of which is transparent. When the energy or voltage responsive substances are excited, they either permit light to pass through a transparent electrode and onto the viewer, or generate light which passes through a transparent electrode and onto the viewer. Liquid crystal displays (LCD), electroluminescent displays (EL), plasma displays, and electrochromic displays are among the devices using at least one transparent electrode at a pixel site. These displays employ orthogonal electrically conductive row and column electrodes in various ways to induce a visible pixel site to a viewer. The electrodes are commonly patterned, i.e., arranged in rows and columns. Energy or voltage responsive materials are disposed between the electrodes. When a voltage is created between the electrodes, and the materials respond, light is transmitted toward the viewer. In order for light to pass through the electrode and onto the viewer, the row electrodes, the column electrodes, or both electrodes must be fabricated from a transparent material. As stated in U.S. Pat. No. 5,342,477 assigned to the assignee of the present invention and which is hereby incorporated by reference, the transparent electrode material must also be highly conductive. In these types of devices, the transparent electrodes are not bombarded with electrons (having energies ranging from a few hundred to thousands of volts) and consequently a variety of materials which are conductive and transparent may be utilized, for example, indium tin oxide and tin oxide. Indium tin oxide is more conductive for a given thickness, it is more transparent for a given thickness, and it is easier to etch than tin oxide. In addition, indium tin oxide forms very smooth thin films. Consequently, indium tin oxide is preferred for these types of displays.

A promising technology is the use of a matrix-addressable array of cold cathode emission devices to excite phosphors on a screen. These field emission displays operate on the principle of cathodoluminescent phosphors excited by cold cathode field emission electrons. The faceplate having a cathodoluminescent phosphor coating receives patterned electron bombardment from an opposing baseplate thereby providing a light image which can be seen by a viewer. The faceplate is separated from the baseplate by a vacuum gap, an outside atmospheric pressure is prevented from collapsing the two plates together by physical standoffs between them, often referred to as spacers. Arrays of electron emission sites (emitters) are typically sharp cones that produce electron emission in the presence of an intense electric field. A positive voltage is applied to an extraction grid relative to the sharp emitters to provide the intense electric field required for generating cold cathode electron emission. The electrons bombard and strike the transparent conductor on which the phosphors are located. In the case of indium tin oxide conductors, it has been found that over a period of time, there is a visible deterioration of the field emission display which is exhibited by a browning of the conductor and an increase in resistivity of the conductor.

Consequently, there is a need for a transparent conductor which does not deteriorate over time due to electron bombardment. Moreover, there is a need for a transparent conductor whose resistivity does not increase over time due to electron bombardment.

SUMMARY OF THE INVENTION

The invention is directed to transparent conductors for the faceplate anode of field emission displays comprised of tin antimony oxide. In addition, the present invention is directed to a transparent conductor for field emission displays comprised of tin oxides and methods of fabricating the same.

BRIEF DESCRIPTION OF THE DRAWINGS

The present invention will be better understood from reading the following description of nonlimitative embodiments, with reference to the attached drawing, wherein.

Figure 1:
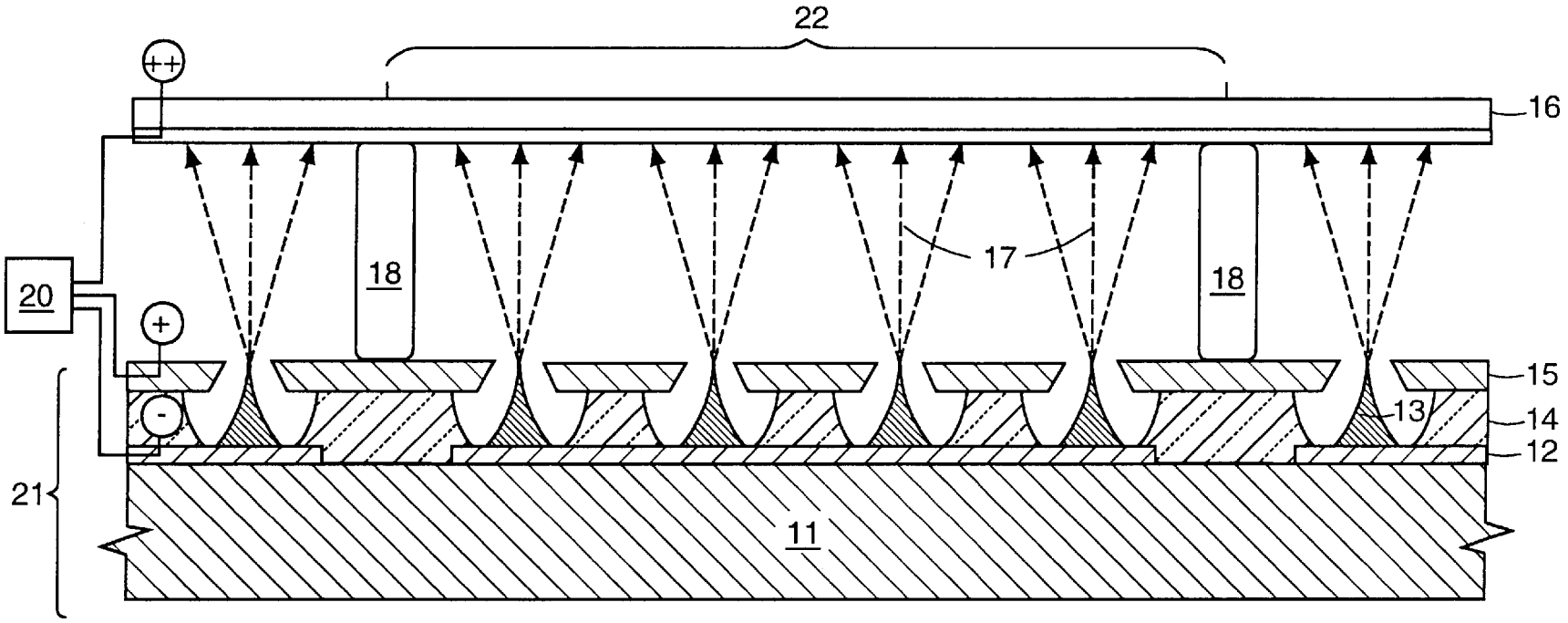
FIG. 1, is a cross-sectional schematic drawing of a pixel of a field emission display consisting of a faceplate with a phosphor screen, vacuum sealed to a baseplate which is supported by spacers.

It should be emphasized that the drawing in the instant application is not to scale but are merely schematic and not intended to portray the specific parameters of the structural details of a field emission device which are known in the art.

DETAILED DESCRIPTION OF THE INVENTION

Referring to FIG. 1, a pixel 22 of a field emission display employing a cold cathode is depicted. Preferably, a single crystal silicon layer serves as a baseplate substrate 11 onto which a conductive material layer 12, such as doped polycrystalline silicon, has been deposited. At the field emission cathode site locations, conical micro-cathodes 13 have been constructed on top of substrate 11. Surrounding the micro-cathodes 13, is a micro-anode structure 15. When a voltage differential through source 20 is applied between the cathode 13 and the gate 15, a stream of electrons 17 is emitted toward a phosphor coated screen 16. Display screen 16 having a faceplate substrate comprised of glass serves as an anode. The faceplate includes a transparent conductor 22. Electron emission tips 13 are integral with the single crystal semiconductor substrate 11 and serve as a cathode conductor. Gate 15 serves as a low potential anode or grid structure for cathode tips 13. Insulating layer 14 is deposited on conductive cathode layer 12. Insulator 14 also has openings at the field emission site locations. Support structures 18, also referred to as spacers, are located between the display faceplate 16 and baseplate 21.

The present invention is directed to materials used to comprise the transparent conductor 22. During operation, electrons directly bombard transparent conductor 22. The present invention includes, according to one embodiment, a transparent conductor for a field emission display faceplate wherein the conductor is comprised of tin antimony oxide. Preferably, according to one embodiment, the conductor is comprised of approximately from about 90% to about 99% tin oxide and from about 1% to about 10% antimony. Most preferably, the conductor, according to one embodiment of the present invention, is comprised of from about 90% to about 100% tin oxide and up to about 10% antimony. The transparent conductor of the present invention can be fabricated utilizing techniques known in the art, e.g., U.S. Pat. No. 2,429,420, U.S. Pat. No. 2,564,707, German Patent No. 1,045,612 and V. M. Vaynshetyn, Sov. J. Opt. Technol., Vol. 34, p. 45 (1967) which are hereby incorporated herein by reference.

The transparent conductor of the present invention may be fabricated and applied using techniques disclosed in the art, for example, see U.S. Pat. No. 5,342,477, assigned to the assignee of this application, which is hereby incorporated by reference. Other deposition techniques can also be utilized including spray pyrolysis, pyrolytic techniques, reactive sputtering, and glow discharge decomposition techniques, etc. (See, e.g., R. E. Aitchinson, Aust. J. Appl. Sci., Vol. 5, p. 10 (1954); O. Tabata, "Proceedings of the Fifth International Vapor Deposition," p. 681, Electrochem. Soc. Princeton, N.J. (1975); L. Holland and G. Sidall, Vacuum, Vol. 3, p. 375 (1953); and U.S. Pat. No. 3,239,368 which are all hereby incorporated herein by reference.

While the particular embodiments as disclosed herein in detail are fully capable of obtaining advantages and objectives herein stated, it is to be understood that they are merely illustrative of the presently preferred embodiments of the invention and in no way are the details of construction or design herein shown intended to be limitations other than as described in the appended claims.

I claim:

1. A field emission display comprising:

a baseplate having an electron emitter;

a faceplate having a phosphor coated screen and transparent conductor, said conductor comprising tin antimony oxide, said faceplate being spaced apart from said baseplate and the space between said faceplate and said baseplate being at least partially evacuated to provide at least a partial vacuum between said faceplate and said baseplate.

2. A display according to claim 1, said tin antimony oxide comprising a first percentage of tin oxide and a second percentage of antimony, said first percentage being larger than said second percentage.

3. A display according to claim 1, said first percentage being in a range from about 90% to about 99% and said second percentage being in a range from about 1% to about 10%.

4. A field emission display comprising:

a screen including a phosphor coating and a transparent conductor, said transparent conductor comprising tin antimony oxide; and an electron emitter for emitting electrons that travel towards said screen, said electron emitter being spaced apart from said screen and the space between said electron emitter and said screen being at least partially evacuated to provide at least a partial vacuum between said electron emitter and said screen.

5. A display according to claim 4, said electron emitter comprising a plurality of micro-cathodes.

6. A display according to claim 5, each of said micro-cathodes being characterized by a conical shape.

7. A display according to claim 5, said electron emitter further comprising a baseplate, each of said micro-cathodes being disposed over said baseplate.

8. A display according to claim 7, said electron emitter further comprising an insulator disposed over said baseplate and between individual ones of said micro-cathodes.

9. A display according to claim 8, each of said micro-cathodes including a base portion and a tip, said base portion being proximal to said baseplate and said tip being distal to said baseplate.

10. A display according to claim 9, said electron emitter further comprising a gate disposed over said insulator and proximal said micro-cathode tips.

11. A display according to claim 10, further comprising a spacer for separating said emitter from said screen.

12. A display according to claim 10, further comprising a power supply for maintaining at least some of said micro-cathode bases at a first potential, said gate at a second potential higher than said first potential, and said transparent conductor at a third potential higher than said second potential.

13. A field emission display comprising:

a conductive material;

a conical micro-cathode having a base and a tip, said base being electrically connected to said conductive material;

a conductive grid disposed proximal said tip;

a screen comprising a phosphor coating and a transparent conductor, said transparent conductor comprising tin antimony oxide;

a spacer separating said grid and said screen;

a power supply for maintaining said conductive material at a first potential, said grid at a second potential higher than said first potential, and said transparent electrode at a third potential higher than said second potential so that electrons emitted from said micro-cathode tip travel towards said transparent electrode.

* * * * *